United States Patent [19]

Dubberly et al.

[11] 4,253,573

[45] Mar. 3, 1981

[54] APPARATUS FOR HANDLING EMPTY BEVERAGE CONTAINERS

[75] Inventors: Gregory T. Dubberly, Atlanta, Ga.; Robert J. McGowan; Larry R. Butcher, both of Xenia, Ohio

[73] Assignee: The Mead Corporation, Dayton, Ohio

[21] Appl. No.: 63,501

[22] Filed: Aug. 3, 1979

Related U.S. Application Data

[63] Continuation of Ser. No. 924,854, Jul. 17, 1978, abandoned.

[51] Int. Cl.[3] ..... B07C 5/10

[52] U.S. Cl. ..... 209/525; 209/651; 209/925; 209/936; 250/223 B

[58] Field of Search ..... 209/523, 524, 525, 606, 209/651, 654, 925, 936; 250/223 R, 223 B; 356/240

[56] References Cited

U.S. PATENT DOCUMENTS

| | | | |
|---|---|---|---|
| 2,732,067 | 1/1956 | Cunningham et al. | 209/606 X |
| 3,067,412 | 12/1962 | Dixon | 209/936 X |
| 3,365,699 | 1/1968 | Foster | 340/146.3 |
| 3,455,444 | 7/1969 | Simmons | 209/586 |
| 3,472,374 | 10/1969 | Ness et al. | 209/936 X |
| 3,513,444 | 5/1970 | Henderson et al. | 356/157 X |
| 3,529,169 | 9/1970 | Heaney et al. | 250/223 B |
| 3,549,890 | 12/1970 | Keller | 250/223 B |
| 3,669,263 | 6/1972 | Babb | 209/524 |
| 3,837,486 | 9/1974 | Gardner | 209/524 |
| 3,840,857 | 10/1974 | Knight et al. | 250/223 R |
| 3,955,179 | 5/1976 | Planke | 250/223 B |
| 4,027,797 | 6/1977 | Eberle | 209/651 |
| 4,055,834 | 10/1977 | Planke | 250/223 B |
| 4,120,403 | 10/1978 | Stephanos | 209/586 |

*Primary Examiner*—Joseph J. Rolla

*Attorney, Agent, or Firm*—Biebel, French & Nauman

[57] ABSTRACT

An apparatus for receiving and handling empty beverage containers. The empty containers may be received either individually or in cartons upon a moving conveyor. An alignment mechanism separates the containers and moves them to one side of the conveyor. A switch arrangement senses cartons, so that the system can process cartons of empty containers in a different manner than individual empty containers. The containers, whether individually or in cartons, pass through an illumination station wherein they interrupt illumination falling upon a row of photocells. Output signals from the photocells are transmitted to identification circuitry together with clock signals generated in synchronism with the movement of the conveyor. The identification circuitry generates registration signals, which are used to compute value of the containers being received. A paddle mechanism shifts the cartons to a separating station, which forwards properly filled cartons to a storage area. Improperly filled cartons are returned to a point near the receiving area.

14 Claims, 11 Drawing Figures

ACCEPT
REJECT

REGISTRATION

APPARATUS FOR HANDLING EMPTY BEVERAGE CONTAINERS

CROSS REFERENCE TO RELATED APPLICATION

This application is a continuation of our earlier application, Ser. No. 924,854, filed July 17, 1978 and now abandoned.

BACKGROUND OF THE INVENTION

This invention relates to systems for receiving and evaluating empty beverage containers of a type known in the trade as returnable. These are containers, usually glass bottles, for which the beverage purchaser is charged a deposit fee at the time of purchase. When the purchaser returns the empty container to a designated redemption center, the deposit fee is refunded. Most beverage sales outlets also operate redemption centers, and the operation of these centers is usually a troublesome matter which takes clerks away from other more profitable tasks.

Beverages are commonly sold in containers of many different sizes, and in cartons containing groups of six or eight such containers. The customer may return the containers either individually or in cartons and may mix different types of containers in a single carton. It is the task of the redemption center clerk to sort or classify the containers in accordance with their deposit values and to calculate the refund which is due. The clerk may make an actual refund or may give the customer a refund slip which can be redeemed at another location. This operation is so unprofitable that many supermarkets simply operate on an honor system, whereby customers stack their empties at a receiving location and report the return to a checkout clerk, who makes the appropriate refund.

An alternative to the above described redemption techniques is an automatic system such as a system of the type described in Planke U.S. Pat. No. 3,955,179. This system has a pair of conveyors, one for individual empty bottles and one for cartons. In operation the customer places the returned bottles and cartons on the appropriate conveyor for transportation through an illumination station. At the illumination station the containers are illuminated by a beam of collimated light, and a shadow of the containers is projected against an array of photodetectors. The containers are identified by their shadows. This identification results in control signals for a logic network which computes the amount of the refund and controls the printing of a refund slip by an associated printer.

SUMMARY OF THE INVENTION

The present invention relates to apparatus for receiving individual empty beverage containers and cartons of empty beverage containers on a conveyor and handling the containers for refund purposes. An oscillating alignment arm urges the individual containers and the cartons into single file progression for passage through an illuminating station. A switch arrangement recognizes cartons for conditioning identification means. An arrangement of photocells within the illumination station transmit other signals to the identification means as a result of which properly filled cartons are distinguished from improperly filled cartons. At the same time the return value of all empty containers is determined. A paddle mechanism moves the cartons off the conveyor to a separating station. The paddle mechanism includes a series of paddles swung in ferris wheel fashion upon a pair of chains. An arm and track arrangement provide the necessary support for maintaining the paddles firmly against the cartons. At the separating station a roller arrangement transports properly filled cartons in one direction for storage. Improperly filled cartons are transported in another direction for return to the customer.

DESCRIPTION OF THE PREFERRED EMBODIMENT

Figure 1:
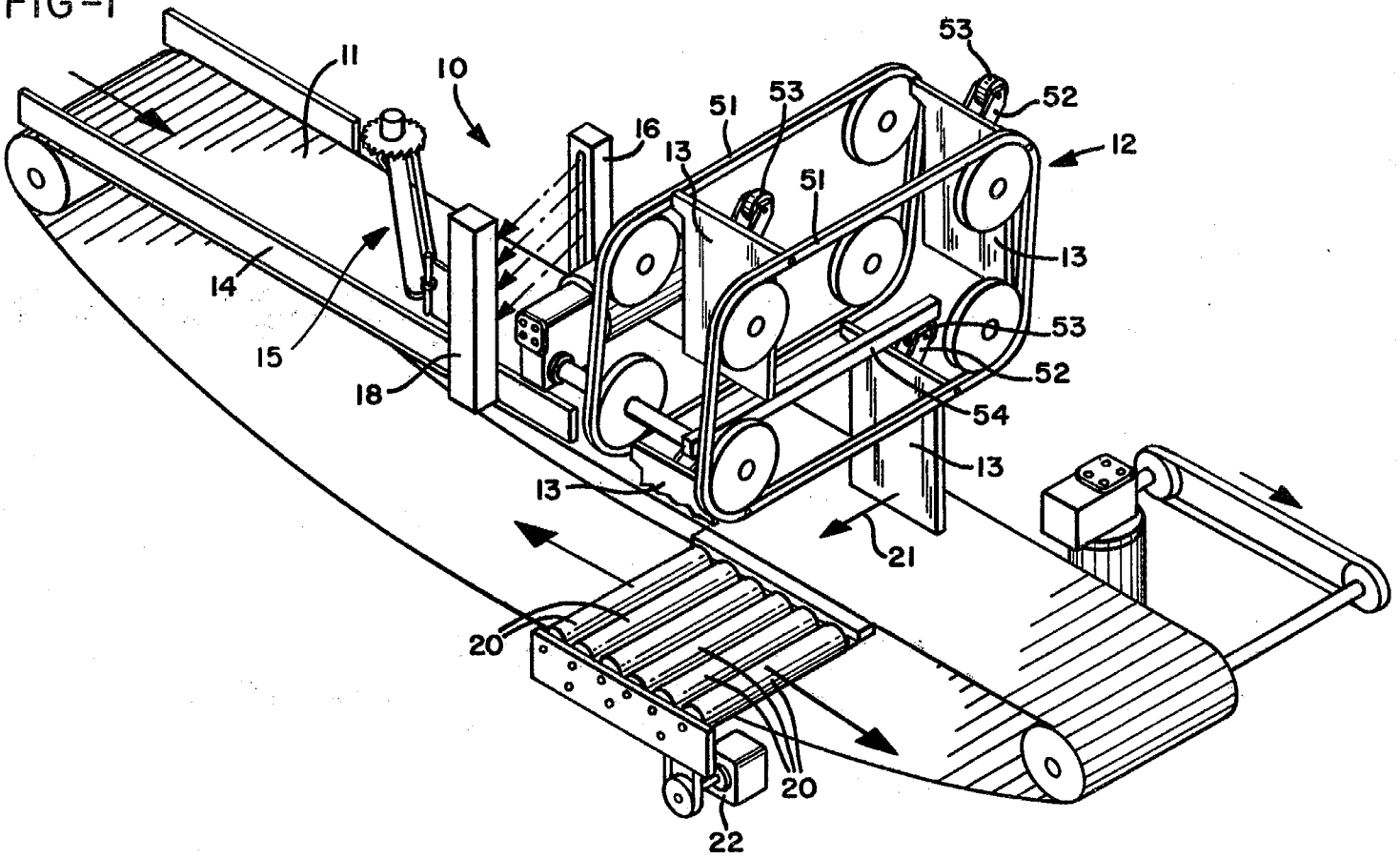
FIG. 1 is a schematic drawing of the mechanism of this invention.

A conveyor arrangement 10 in accordance with this invention may be constructed as schematically illustrated in FIG. 1. The arrangement includes a conveyor belt 11, with associated driving elements, aligning mechanism as indicated generally at 15 and a paddle arrangement as indicated generally at 12. The cooperating operation of conveyor belt 11, paddle arrangement 12, and aligning mechanism 15 can best be understood by reference to FIG. 2.

Movement of belt 11 is initiated by pushing a start button on a control panel (not illustrated). A customer who wishes to obtain a refund for empty beverage containers pushes the start button and thereafter loads individual empty containers 23 and cartons of empty containers 24 upon belt 11. Loading is performed at a receiving station, which is separated from the major portions of conveyor 10 by a wall 25.

After being loaded upon belt 11, individual containers 23 and cartons 24 are met by a friction surface 26 on arm 27 of aligning mechanism 15. A ratchet arrangement causes arm 27 to oscillate back and forth as illustrated generally by the arrow 28, and this urges the containers and cartons sidewardly against sideboard 14. Sideboard 14 has a friction surface, which retards forward movement of the containers and cartons. The containers and cartons are trapped against sideboard 14 and behind arm 27 until released by outward movement of the arm. A blade 29 is pivotally attached to arm 27 and is urged against the cartons and containers by a spring mechanism 30. This produces separation between the cartons and containers in the direction of belt movement.

After movement past aligning mechanism 15, the containers and cartons pass a series of microswitches (not illustrated), which are positioned so as to be actuated only by cartons. Thereafter the containers and cartons pass into an illumination region between an illuminating apparatus 16 and a series of photosensors 18. Illuminating apparatus 16 generates a series of illuminating beams 17, which are directed angularly with respect to the direction transverse to the direction of conveyor movement. The angle between the beam direction and the transverse direction is preferably in the order of about 18 degrees, so that the identification circuits can recognize pairs of containers within a carton. Each beam 17 is directed toward an individual photocell 31 (FIG. 3), and the beams are preferably beams of collimated infrared light produced by TIL 31 infrared light sources and collimating lenses. Preferably each beam 17 has a diameter in the order of about one-quarter inch.

After passage through the illuminating station the containers and cartons pass under paddle arrangement 12. Paddle arrangement 12 includes a series of paddles 13, which may be actuated to move in the direction indicated by the arrow 21. Paddle arrangement 12 is actuated whenever a carton 24 is positioned thereunder. As mentioned previously, the system is conditioned by a series of switches to discriminate between cartons and individual containers. Thus paddle arrangement 12 is never actuated during passage of an individual container thereunder, so that individual containers are carried along to a bottle storage area.

When paddle arrangement 12 is actuated, a paddle 13 is brought into contact with the side of a carton, and the carton is pushed transversely onto a separating station 19. Paddles 13 swing freely in ferris wheel fashion on chains 51, but during the lower quadrant of their movement, they are held rigidly downward by arms 52 which include a roller 53 for bearing against a track 54. This enables the paddles to push sidewardly against cartons.

Separating station 19 comprises a series of rollers 20, which are driven either forwardly or reversely by a drive motor 22. If the system recognizes the carton as being properly loaded, then drive motor 22 drives rollers forwardly, and the carton is accepted. If the carton is improperly loaded with bottles of different size or has empty cells, then motor 22 drives rollers 22 reversely, and the carton is rejected.

Figures 2, 3:
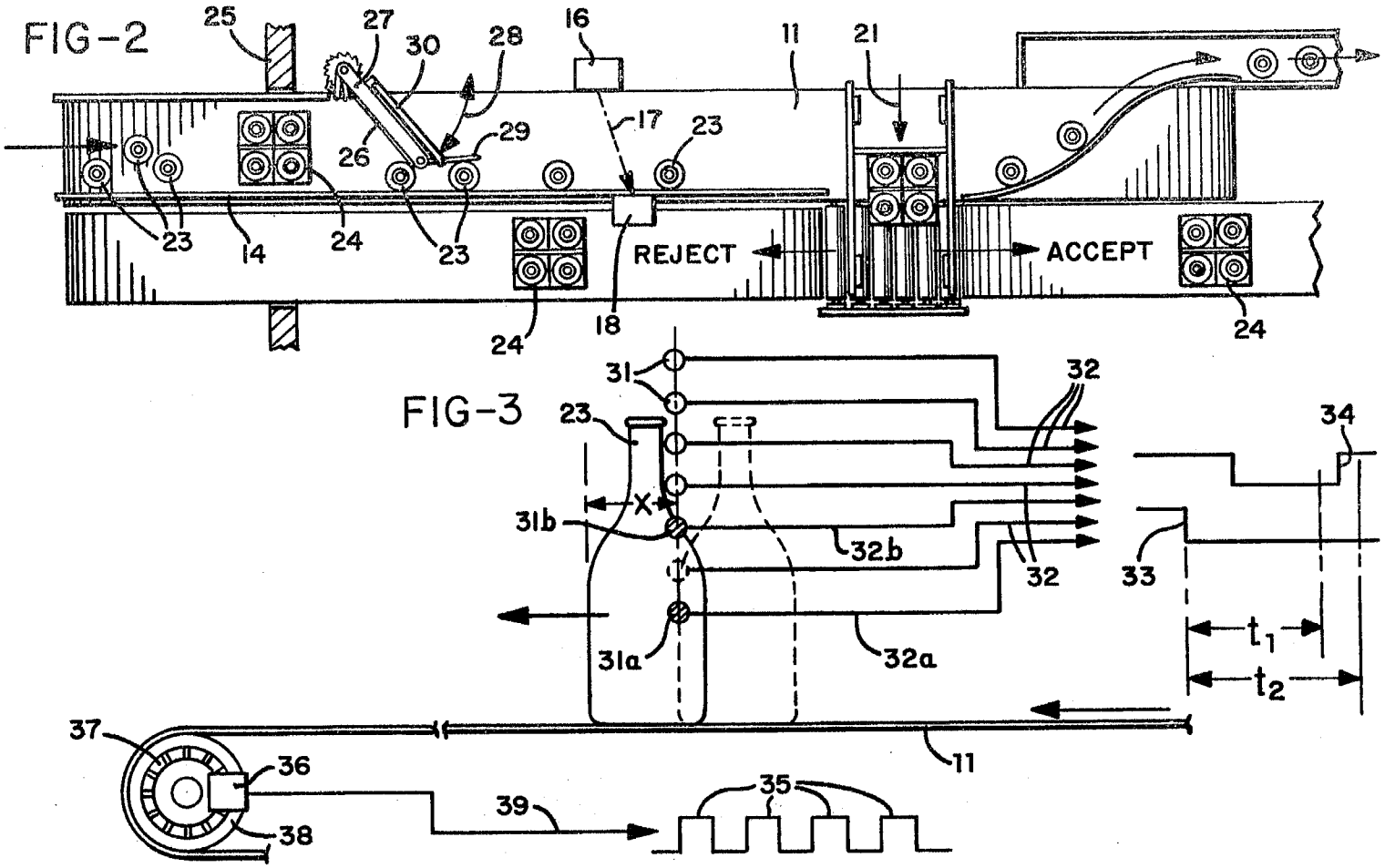
FIG. 2 is a plan view of container handling mechanism in accordance with this invention.
FIG. 3 is a schmatic illustration of container movement during recognition by a row of photocells and associated circuitry.

The technique for identifying a container for refund purposes can be understood by reference to FIG. 3. As the belt 33 carries a container 23 in front of photosensor array 18, the light falling upon the vertically arranged row of photocells 31 is periodically blocked. Each photocell 31 has an output line 32, which transmits an electrical signal corresponding to light and dark conditions at the photocell. By way of example, the illustrated photocell 31*a* may be the first photocell to sense the presence of the container 23. This causes a transition in the output signal from line 32*a* as indicated at 33. A second photocell 31*b* has a light to dark transition somewhat later in time, followed at a still later time by a dark to light transition, both transitions being indicated by the output signal on line 32*b*. The latter transition on the output signal from line 32*b* is indicated by the reference numeral 34. Lines 32 are connected through a series of gates to different ones of a plurality of registration circuits. For processing the container illustrated in FIG. 3, one such registration circuit is connected to lines 32*a* and 32*b* and is configured in such a manner as to generate a registration pulse if the transition 34 occurs after time $t_1$ and before time $t_2$. The time period between time $t_1$ and $t_2$ is established by counting a series of clock pulses 35 generated by an encoder 36 arranged for viewing an optical disc 37 mounted on the drive motor 38. Output pulses from encoder 36 are carried by line 39.

It will be seen that clock pulses 35 occur in synchronism with the actual physical movement of container 23. In a typical case such an encoding arrangement may generate a new clock pulse 35 each time container 23 moves a distance of 0.01 inches. Thus by counting the clock pulses 35 the registration circuitry responds to beverage containers having a particular horizontal dimension within some predetermined dimensional range. For instance, a particular registration circuit may be configured for recognizing bottles having an illustrated dimension X equal to 2.5 inches. A bottle meeting this criterion would cause the transition 34 to occur on line 32*b* at a point in time determined by counting 250 of the clock pulses 35. In order to allow for some error a registration "window" of perhaps 20 clock pulses might be employed. This would cause generation of a registration signal for bottles having a dimension X ranging between 2.4 inches and 2.6 inches. It is apparent that a system constructed in accordance with this invention could be made to recognize a great many different registration conditions.

Electrical circuitry for controlling the apparatus of FIGS. 1 and 2 and generating container value signals is illustrated in FIGS. 4A, 4B, 5A, 5B, 6A, 6B, 7A, and 7B. In addition to the illustrated circuitry the apparatus utilizes fairly conventional power supplies, display controls, transmission lines, clock signal generators, photosensor drivers, and amplifiers. Table I lists circuit types for integrated circuits illustrated in the detailed electrical schmatics presented herein.

TABLE I

| Reference Numeral | Circuit Type |
|---|---|
| 401 | 4013 |
| 402 | 14557 |
| 403 | 14557 |
| 404 | 4013 |
| 405 | 14557 |
| 406 | 14557 |
| 407 | 14557 |
| 408 | 14557 |
| 409 | 4013 |
| 410 | 4013 |
| 411 | 4013 |
| 412 | 4013 |
| 413 | 14528 |
| 415 | 14528 |
| 501 | 4076 |
| 502 | 4076 |
| 503 | 4013 |
| 504 | 4013 |
| 505 | 14040 |
| 506 | 4013 |
| 507 | 4013 |
| 601 | 4008 |
| 602 | 4008 |
| 603 | 4008 |
| 604 | 4076 |
| 605 | 4076 |
| 606 | 4076 |
| 607 | 4029 |
| 608 | 4029 |
| 609 | 4029 |
| 701 | 4013 |
| 702 | 4013 |
| 703 | 4013 |
| 704 | 4013 |
| 705 | 4013 |
| 706 | 4013 |
| 707 | 4013 |
| 708 | 4013 |
| 709 | 4013 |
| 710 | 4013 |
| 711 | 4013 |

TABLE I-continued

| Reference Numeral | Circuit Type |
|---|---|
| 712 | 4013 |
| 713 | 4029 |
| 714 | 4013 |

Figure 4A:
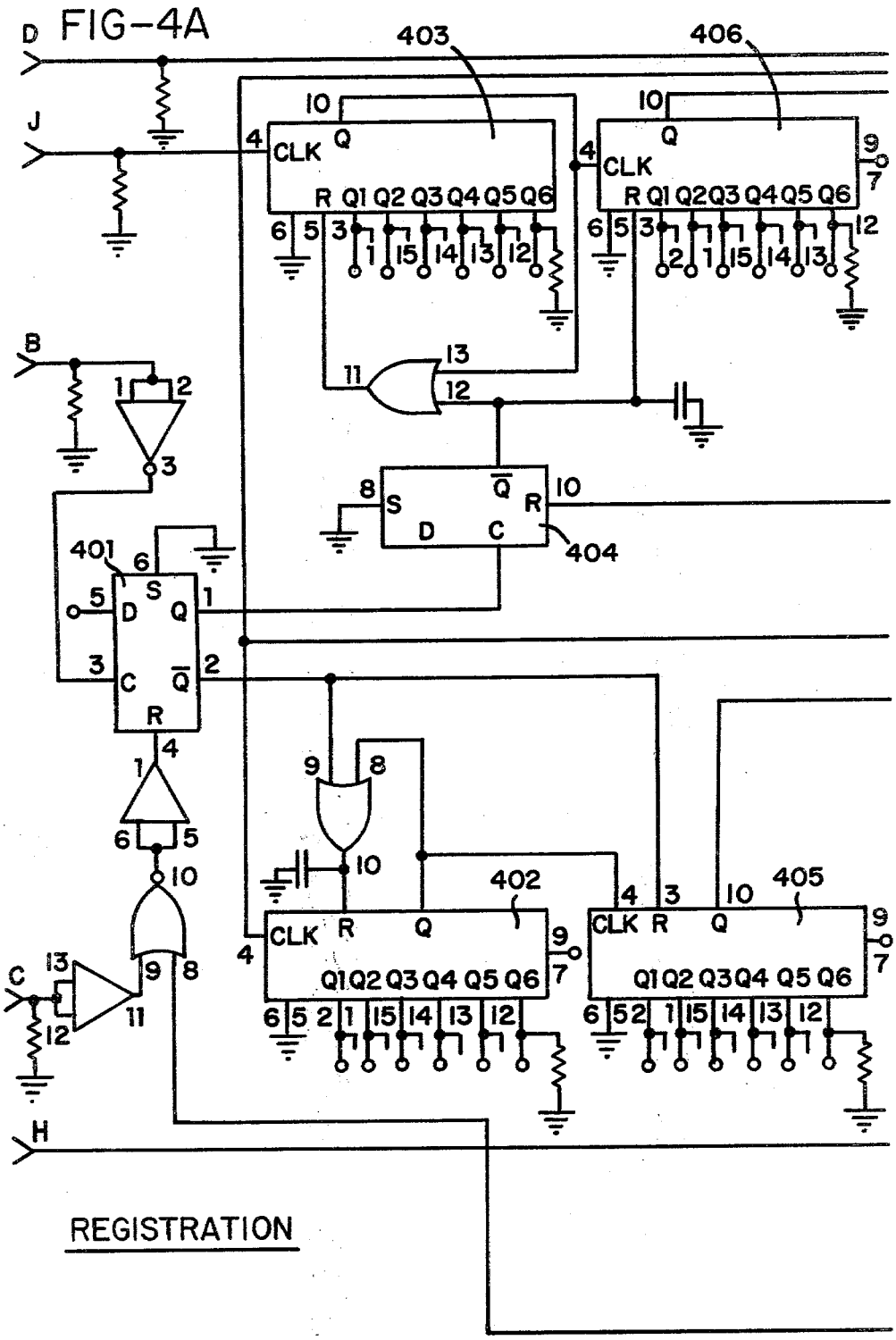
FIGS. 4A and 4B is a schematic drawing of registration circuitry.
Figure 4B:
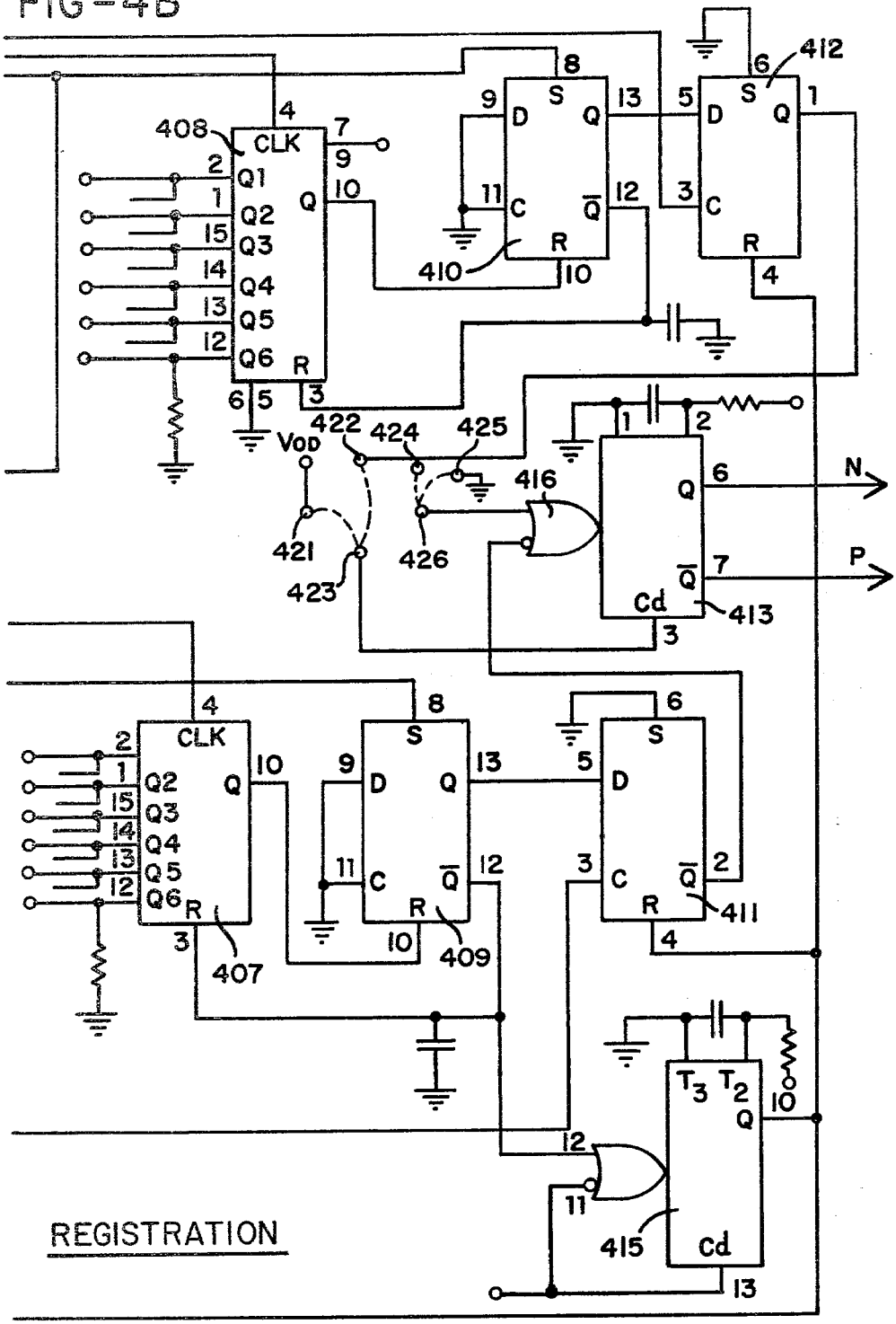

FIGS. 4A and 4B illustrate the registration circuiry, which generates the above mentioned registration pulses. The circuitry of FIGS. 4A and 4B generates a registration signal for a container having a particular dimension within some predetermined range or for different containers having the specified dimension within that range. Typically empty containers can be grouped in groups having some common dimensional characteristic within a relatively small dimensional range and a commn refund value. The circuitry of FIGS. 4A and 4B would generate a registration signal for all such containers, and this registration signal would appear at output terminals 6 and 7 of integrated circuit 413. Containers having a different common dimensional characteristic are identified by registration circuitry similar to the circuitry of FIGS. 4A and 4B but programmed in a different manner as hereinafter described. Additional registration circuits are provided for recognizing pairs of containers positioned within cartons. For such pairs of containers the recognition count begins at the leading edge of one container and terminates at the trailing edge of the other container. This type of recognition or registration is performed by observing those portions of the container pairs which extend upwardly above the sides of the carton.

Conveyor clock pulses 35 are received at terminal J of the registration circuitry and are applied to the clock terminals of counters 402 and 403. Counting of such clock pulses is enabled by a signal at terminal B, and this signal may be the transition 33 appearing on line 32*a* as described above with reference to FIG. 3. The signal level at terminal C also controls conveyor clock counting. Terminal C is connected to that one of photocells 31 which is located at a height immediately over the top of the container. The photocell which is connected to terminal C must be illuminated to order for counting to be enabled.

It will be seen that counter 402 is connected to a counter 405 in serial fashion, so that an output appears at terminal 10 of counter 405 after a predetermined number of conveyor clock pulses have been counted. This count, which takes place during a time period $t_1$ as illustrated in FIG. 3, is controlled by presetting the counting control terminals of counters 402 and 405.

When the present count is reached, flip-flop 409 is set, and counter 407 is enabled to begin counting conveyor clock pulses. Counter 407 is set to count a predetermined number of conveyor clock pulses corresponding to the desired registration window. Flip-flop 409 is reset when this predetermined count has been reached.

While clock 407 is counting, input terminal 5 of flip-flop 411 is HI, so that the flip-flop is conditioned to respond to a signal transition, such as the transition 34, appearing on input terminal H. If the signal transition occurs at terminal H during the registration window, then flip-flop 411 is triggered to produce an output for application to gate portion 416 of integrated circuit 413. Integrated circuit 413 produces registration output signals on its N and P terminals.

Six terminals 421 through 426 are provided for added counting flexibility. For a simple registration, as above described, a jumper is attached between terminals 421 and 423, and another jumper is attached between terminals 425 and 426. Different jumper connections may be made in order to enable registration on the basis of photocell transitions appearing at both of terminals D and H. In the case where photocell transitions appearing at terminal D are to be recognized, counters 403, 406 and 408 are utilized. These counters work in a manner similar to counters 402, 405, and 407 for controlling flip-flops 410 and 412. If it is desired to condition the registration signal output upon occurrence of appropriately timed signal transitions at both of terminals D and H., then a jumper is placed between terminals 422 and 423 and another jumper is placed between terminals 425 and 426. A sequential count registration condition can be made by placing a jumper between terminals 421 and 423 and another jumper between terminals 424 and 426.

Figure 6A:
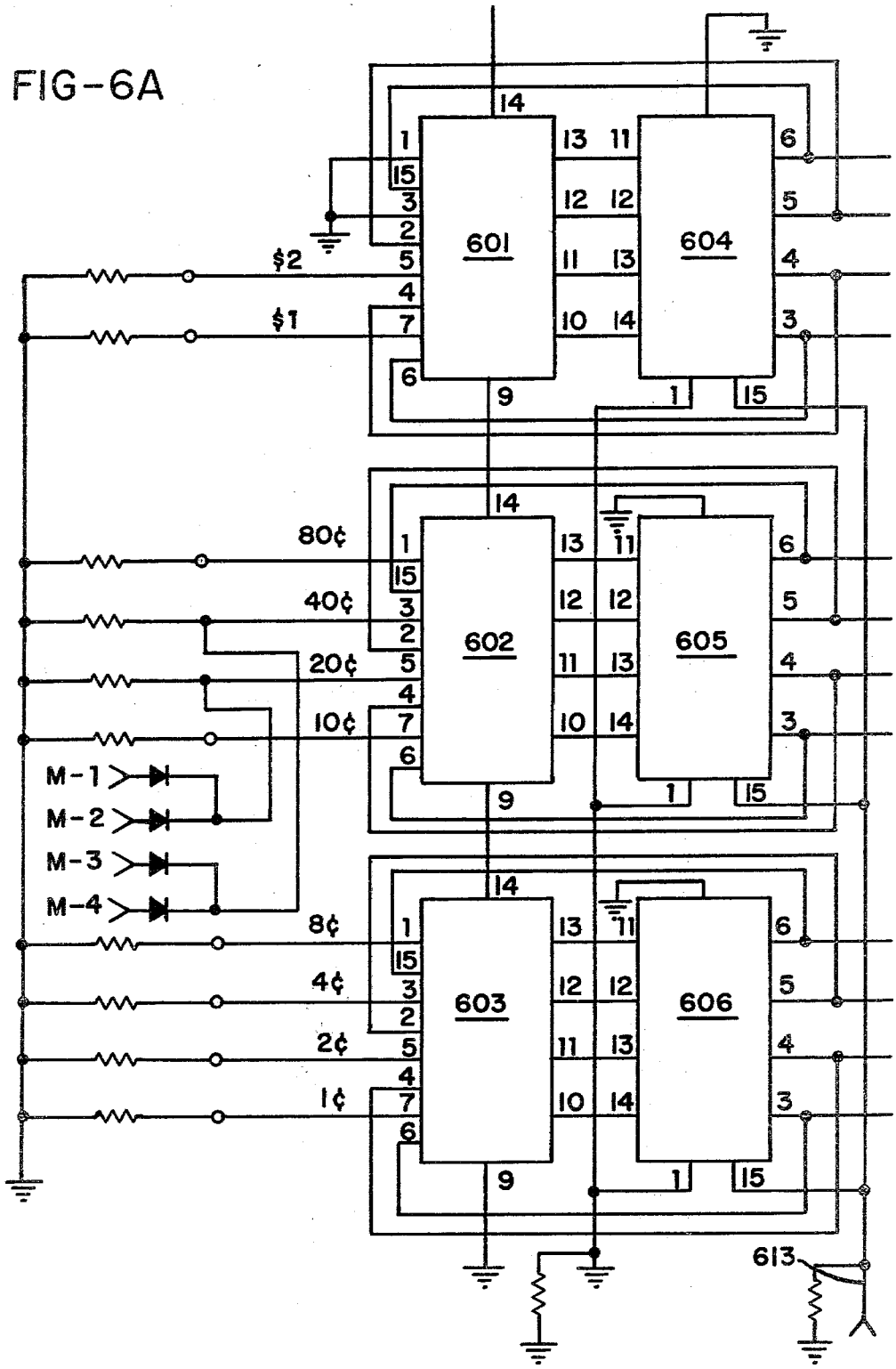
FIGS. 6A and 6B are a schematic drawing of money select circuitry.
Figure 6B:
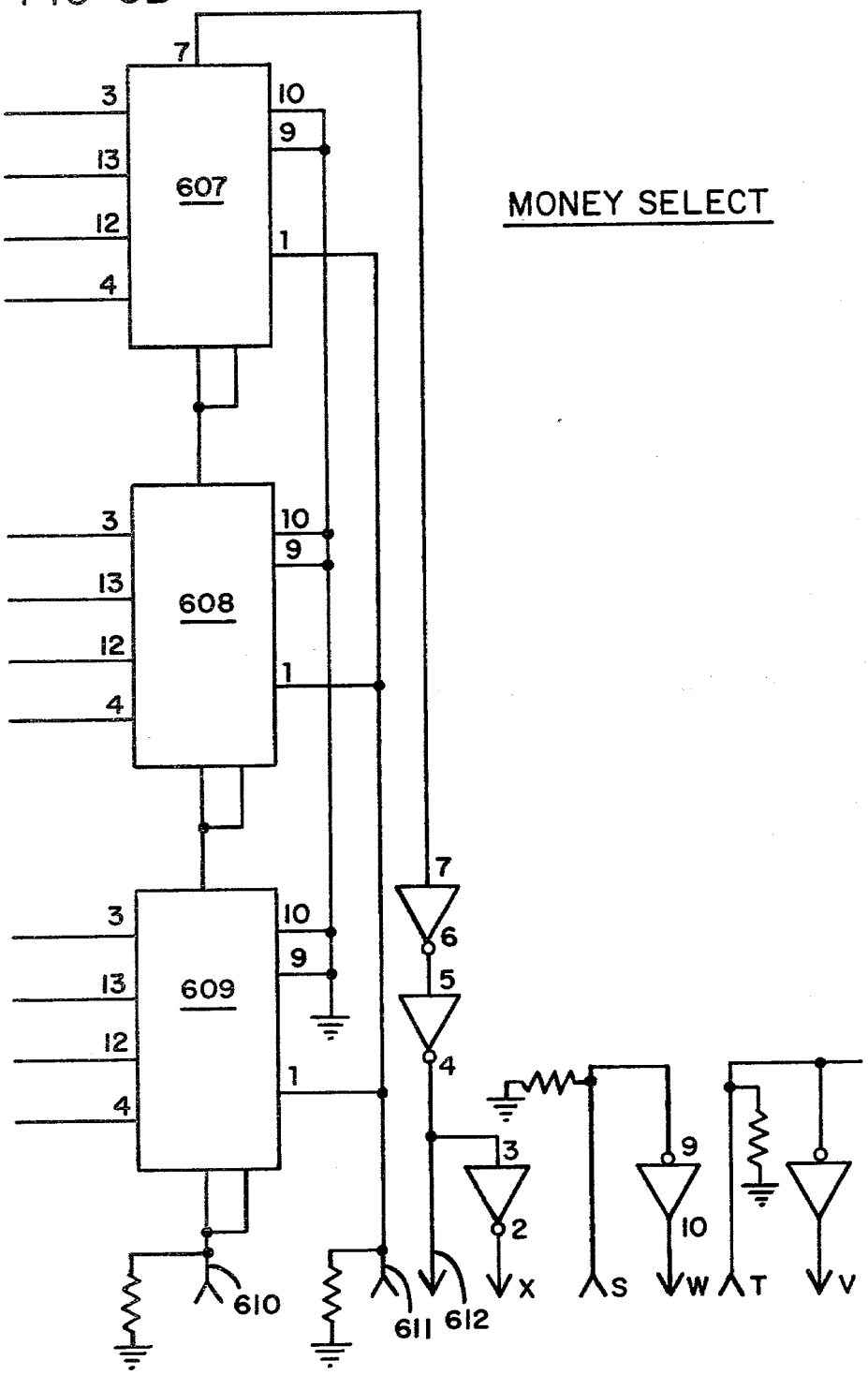

When registration signals are generated by the registration circuitry, they are applied to input terminals for money select circuitry as illustrated in FIGS. 6A and 6B. Connections to this circuitry in general depend upon the types of containers expected. For instance, in a market area wherein there are only 10 cent bottles and 20 cent bottles to be received, the money select circuitry may be connected to receive registration inputs only from terminals M-1 through M-4 as illustrated. Terminal M-1 might be connected to receive registration signals from registration circuitry which recognizes individual 10 cent bottles, while terminal M-2 might be connected to receive registration signals only from circuitry which recognizes pairs of 10 cent bottles arranged side by side in cartons. Similarly, input terminals M-3 and M-4 may receive registration signals for individual 20 cent bottles and 20 cent bottle pairs respectively.

If 10 cent bottles are returned in a six bottle carton, three registration signals will appear at terminal M-2, and three 20 cent counts will be made by the system. If a single 10 cent bottle is registered, then a single 20 cent count is made. The calculation circuitry of FIGS. 7A and 7B perform a division by 2 in order to reduce such a single 20 cent count to a 10 cent output. 20 cent bottles are handled in a similar manner.

For the above example money counts are added by integrated circuits 602 and 605 and later counted down serially through a counting chain comprising counters 607, 608 and 609. For the described arrangement integrated circuits 601, 603, 604 and 606 are not utilized. Counting of the stored money value is initiated by a signal at line 611, which is generated by the calculation circuitry of FIGS. 7A and 7B and appears as an output at line 715 thereof. The money select circuitry counts 100 KHz clock pulses appearing at line 610, and when the countdown is completed a DONE signal appears at line 612.

Figure 5A:
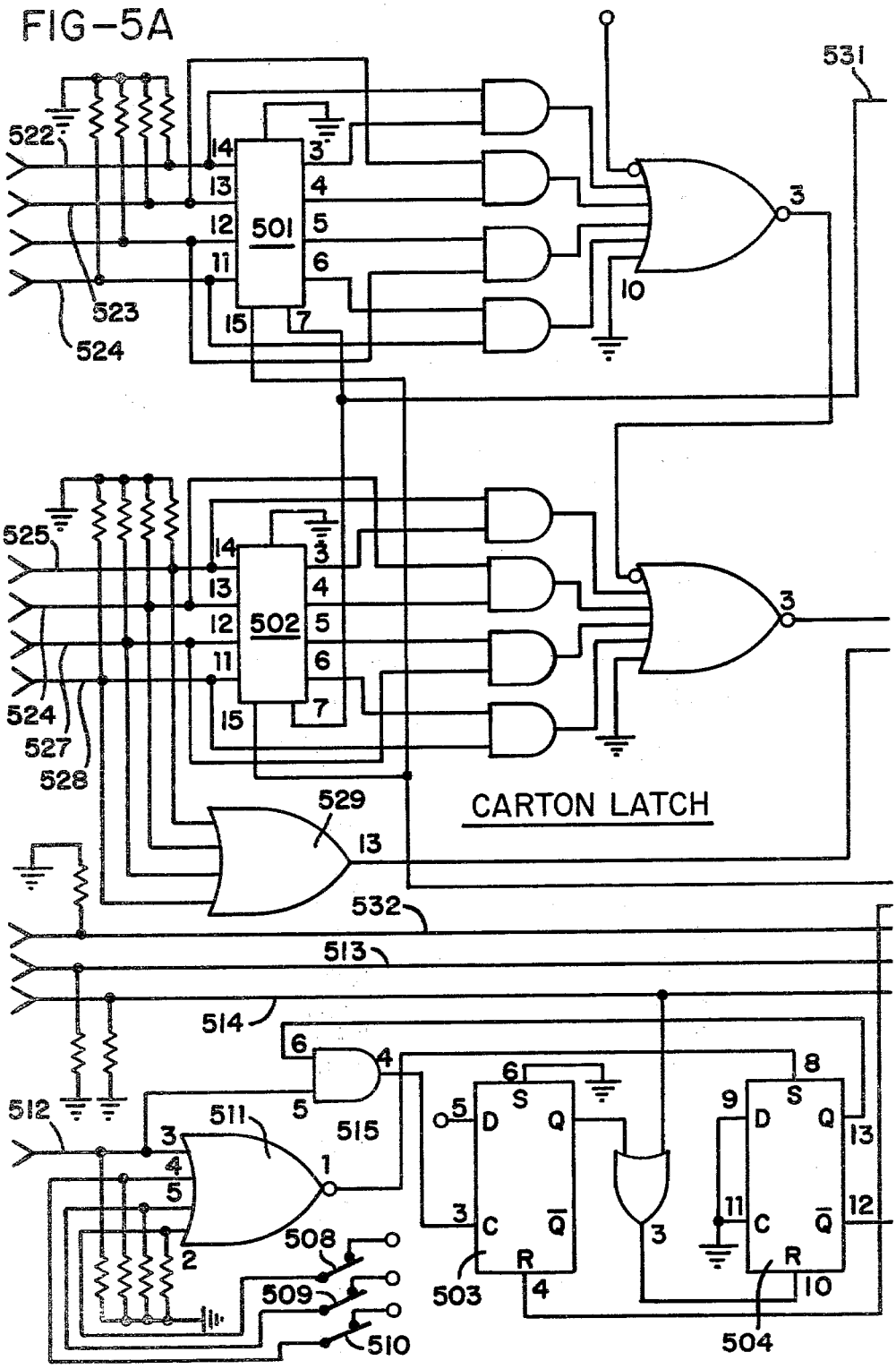
FIGS. 5A and 5B is a schematic drawing of carton latch circuitry.
Figure 5B:
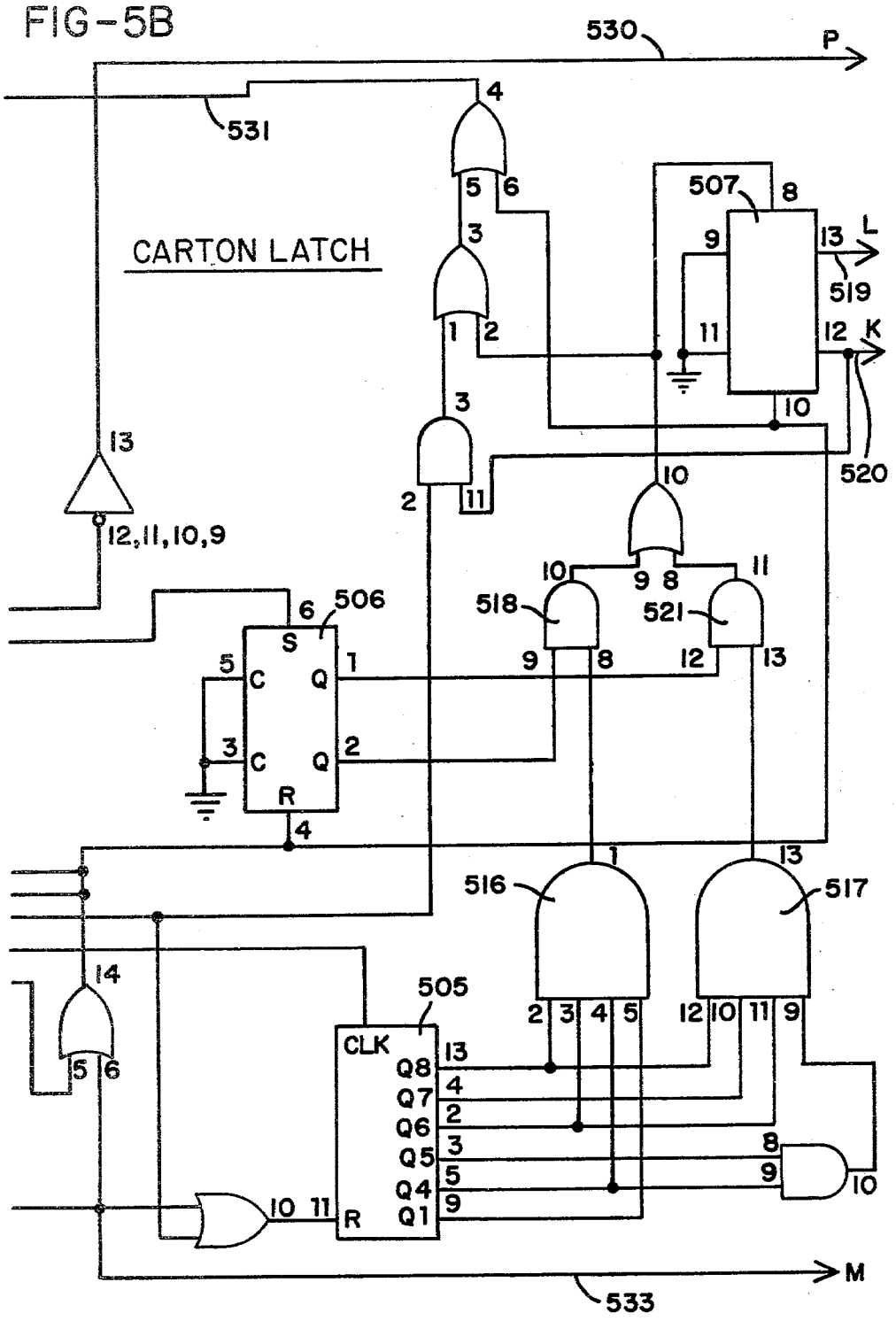

FIGS. 5A and 5B illustrate the carton latch circuitry, which conditions other circuitry for recognizing and handling carton registration information. Carton recognition information is provided by three microswitches located on the conveyor and by the lower most of photocells 31. The three microswitches are illustrated schemtically on FIG. 5A as switches 508, 509 and 510. The input signal from the lowermost photocell is received by the carton latch circuitry on line 512. During a condition when the lower most photocell is darkened and switches 508 through 510 are closed, an output from gate 511 sets flip-flop 504. At the same time gate 515 is activated to permit later shutdown of the system.

When flip-flop 504 is set, the reset output at pin 12 enables counter 505 to begin counting conveyor clock pulses 35 received on line 513. The output count from counter 505 is applied to a small bottle gate 516 and a large bottle gate 517. When the output count from counter 505 indicates a distance equal to the maximum dimension of a pair of small bottles, then gate 516 enables another gate 518. If at that time gate 518 is also sensing a small bottle output signal from pin 2 of flip-flop 506, then flip-flop 507 is set to provide failure signals on lines 519 and 520. Similarly gate 517 creates large bottle failure signals through gate 521 and flip-flop 507. This enables the circuitry of FIGS. 5A and 5B to provide a failure signal on lines 519 and 520 if a carton is detected and one of the carton cells is empty.

Registration signals for bottle pairs are transmitted from the registration circuits to the carton latch circuiry on lines 522 through 528. Registration circuits for large bottle pairs are connected to lines 522 through 524, while registration circuits for small bottle pairs are connected to lines 525 through 528. Signals on lines 522 through 528 control the setting of flip-flop 506 through gate 529. Each time the carton latch circuitry receives a registration signal for a bottle pair (or a single bottle in special type cartons) an output pulse is provided on line 530, provided, however, that no failure signal has previously been generated. Whenever conditions are met for generating a carton failure signal, a signal is also generated on line 531 for inhibiting latches 501 and 502 and preventing transmission of registration signals by line 530.

The carton latch circuitry also utilizes a carton registration delay signal, which it receives on line 532 and a master clear signal, which it receives on line 514.

Figure 7A:
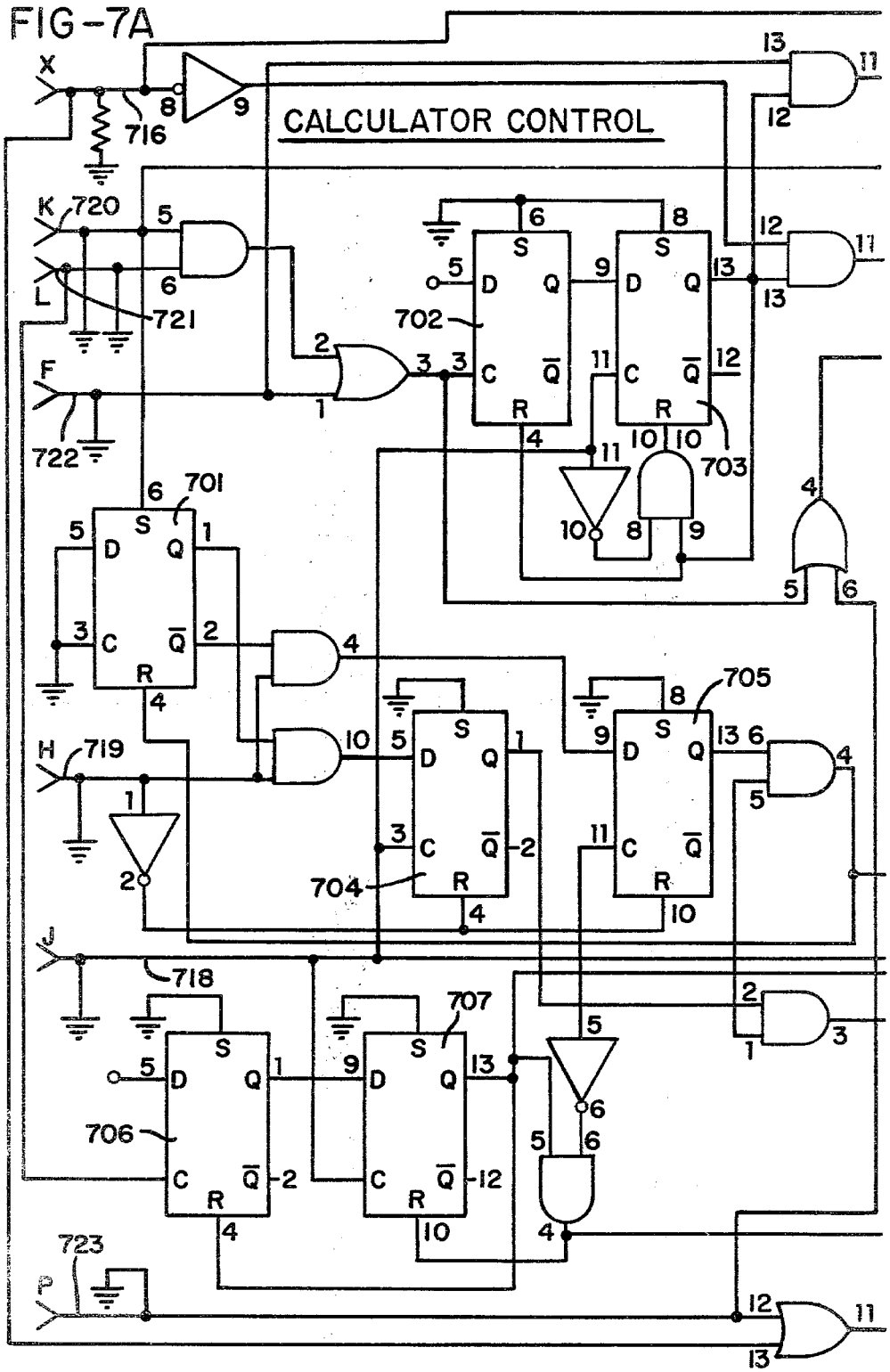
FIGS. 7A and 7B are a schematic drawing of calculation circuitry.
Figure 7B:
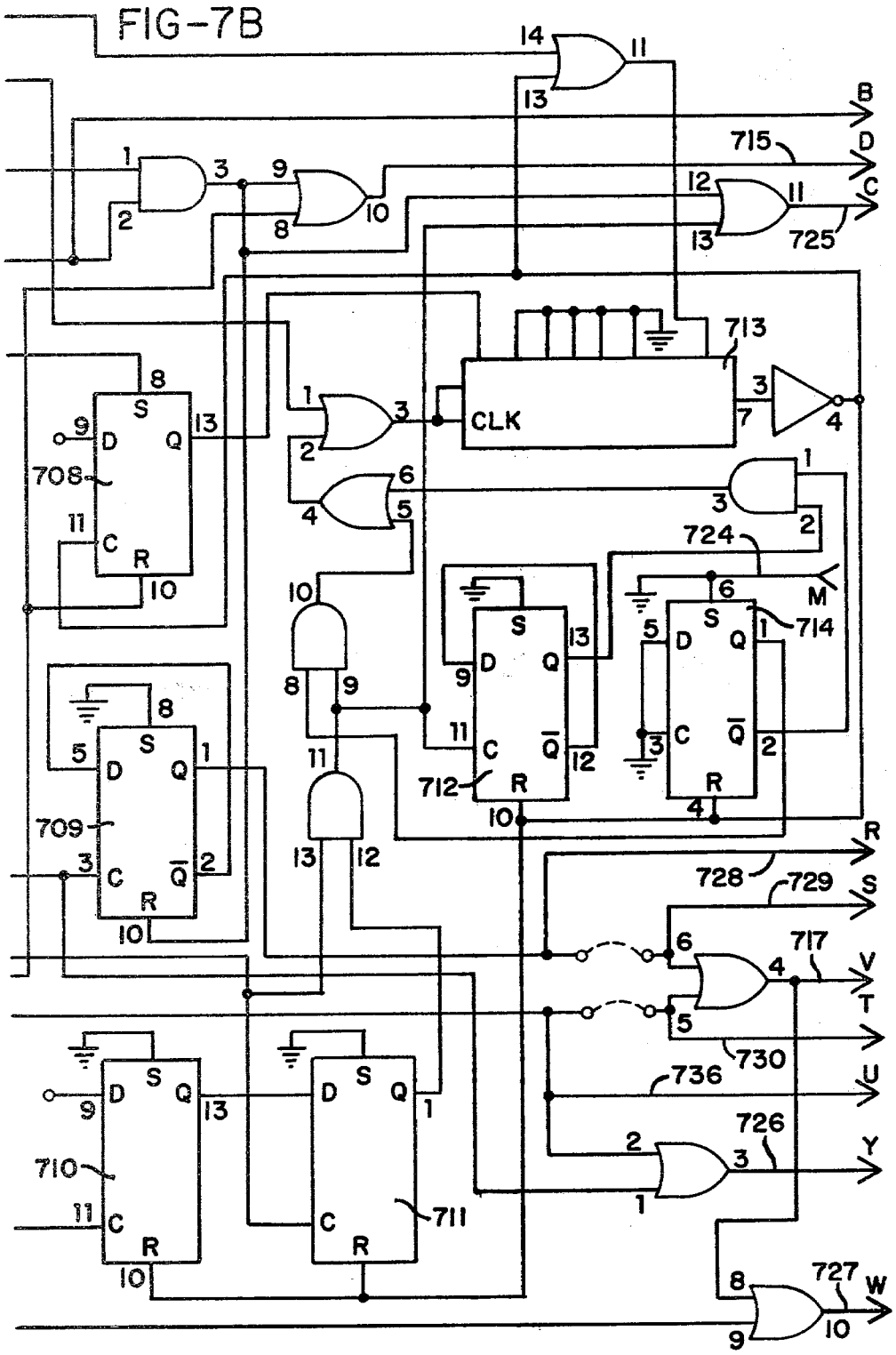

When a carton failure signal appears on line 519, it is transmitted to the calculation circuitry of FIGS. 7A and 7B for reception on line 716. The failure signal on line 520 is transmitted to other circuitry which controls the operation of reversing motor 22.

The calculation circuitry of FIGS. 7A and 7B generally controls other circuitry, not illustrated, which operate displays, printers, coin changers, or the like. The output signal for controlling such peripheral equipment appears as a series of pulses on line 717. Line 717 transmits one pulse for each cent to be printed, indicated or displayed. The calculation circuitry is able to generate the correct number of pulses by counting master clock pulses (100 KHz) on line 718. The counting is carried out synchronously with the money count in the money select circuitry. As stated previously the money select count is initiated by a signal on line 715 of the calculation circuitry and terminates when counters 607 through 609 have been counted down. The DONE signal, which appears on line 612 to signify end of count, is transmitted to the calculation circuitry for reception by line 719.

The calculation circuitry receives other input signals on lines 720 through 724. The signal on line 720 is a delayed registration signal. Whenever the system senses an individual empty container and generates a registration signal at the output of one of the registration circuits, the registration signal is also applied to delay circuitry, not illustrated. After a suitable delay in the order of about 5 microseconds, the registration signal is applied to line 720.

Line 721 receives a carton recognition signal from line 533 of the carton latch circuit. This carton recognition signal prevents double registration when a carton is present.

Line 722 is connected to receive carton registration pulses from line 530 of the carton latch circuit. As stated previously, these pulses represent carton bottle pairs.

Line 723 receives a master clear LO signal from status circuitry, not illustrated. The signal on line 723 goes LO 250 milliseconds after power is applied to the system.

Line 724 receives delayed carton registration signals from delay circuitry, not ilustrated. This signal is required for processing carton having a single row of tandem bottles. The bottle count for single containers is doubled in the bottle select circuitry. The signal on line 724 informs the calculation circuitry that the multiplication need not be performed, even though a carton is present. The multiplication operation is performed through interconnection between flip-flop 712 and counter 713.

Output line 725 carries a bottle count. Line 725 transmits one pulse for each empty beverage container which is recognized by the system. If the containers are carried by a carton, line 725 transmits one pulse for each container in the carton.

Output lines 726 and 727 are connected to the money select circuitry of FIG. 6. Line 726 supplies the clock signal, which is received by the money select circuitry on line 610. Line 727 provides a latch reset signal, which is received by the money select circuitry on ine 613. Lines 728 through 731 are optional calculation output lines for use in computing sales tax.

The money count division, which has been referred to above, is carried out by flip-flop 709. This division provides a true return value for individual empty containers.

While the form of apparatus herein described constitutes a preferred embodiment of the invention, it is to be understood that the invention is not limited to this precise form of apparatus, and that changes may be made therein without departing from the scope of the invention.

What is claimed is:

1. Apparatus for handling empty beverage containers comprising a conveyor for receiving said containers individually and in cartons, alignment means for separating and aligning said containers and cartons, illumination means for illuminating said containers, sensing means for receiving illumination from said illuminating means, evaluation means responsive to said sensing means for generating a value signal corresponding to the return value of said containers, carton sensing means for sensing the presence of a carton on said conveyor, paddle means including a series of moving paddles responsive to said carton sensing means for pushing said cartons sidewardly off said conveyor and onto a separating station, carton failure means responsive to said carton sensing means for detecting an improperly filled carton and generating a carton failure signal, transport means positioned at said separating station for moving properly filled cartons forwardly to a storage area, and reversing means responsive to said carton failure signal for reversing the direction of said transport means and causing improperly filled cartons to be ejected.

2. Apparatus according to claim 1 wherein said paddle means includes a pair of endless chains for pivotally supporting said paddles, a track extending between said chains along their lower course, and arm means attached to said paddles for contacting said track during travel along said lower course and supporting said paddles against said cartons.

3. Apparatus according to either of claims 1 or 2 wherein said transport means comprises a series of side-by-side rollers.

4. Apparatus for handling empty beverage containers comprising a conveyor for receiving said containers individually and in cartons, alignment means for separating and aligning said containers and cartons, illumination means for illuminating said containers, sensing means for receiving illumination from said illuminating means, evaluation means responsive to said sensing means for generating a value signal corresponding to the return value of said containers, carton sensing means for sensing the presence of a carton on said conveyor, a moving paddle responsive to said carton sensing means for pushing said cartons sidewardly off said conveyor and onto a separating station, endless track means for supporting said paddle, carton failure means responsive to said carton sensing means for detecting an improperly filled carton and generating a carton failure signal, transport means positioned at said separating station for moving properly filled cartons forwardly to a storage area, and return means responsive to said carton failure signal for causing improperly filled cartons to be returned from said separating station.

5. Apparatus according to claim 4 wherein said return means comprises meand for reversing the movement direction of said transport means.

6. Apparatus according to claim 5 wherein said transport means comprises a series of side-by-side rollers.

7. Apparatus according to any of claims 4–6 wherein said endless track means comprises a pair of endless chains for pivotally supporting said paddle, a track extending between said chains along their lower course, and arm means attached to said paddle for contacting said track during travel along said lower course and supporting said paddle against said cartons.

8. Apparatus according to claim 7 and comprising a plurality of paddles supported by said endless track means.

9. Apparatus for handling cartons of empty beverage containers comprising a conveyor for receiving said cartons, alignment means for aligning said cartons in single file along said conveyor, sensing means for identifying improperly filled cartons, paddle means for moving improperly filled cartons sidewardly off said conveyor, endless track means supported above said conveyor for pivotally carrying said paddle means around a closed path, a support track, and arm means for supporting said padle means against said track during movement contact against said improperly filled cartons.

10. Apparatus according to claim 9 and further comprising transport means for receiving said improperly filled cartons from said conveyor and transporting them toward a return point.

11. Apparatus according to claim 10 wherein said paddle means move both properly and improperly filled cartons sidewardly off said conveyor; said transport means being reversibly operated in response to said sensing means for moving properly filled cartons toward an acceptance point which is different from said return point.

12. Apparatus according to claim 11 wherein said endless track means comprises a pair of endless chains for pivotally supporting said paddle means therebetween.

13. Apparatus according to claim 12 wherein said paddle means comprises a plurality of vertically suspended paddles.

14. Apparatus according to claim 13 wherein said transport means comprises a series of side-by-side rollers.

* * * * *